US005704722A

United States Patent [19]

Kanou

[11] Patent Number: 5,704,722

[45] Date of Patent: Jan. 6, 1998

[54] PRINTING DEVICE

[75] Inventor: Toshiyuki Kanou, Tokyo, Japan

[73] Assignee: MAX Co., Ltd., Tokyo, Japan

[21] Appl. No.: 709,338

[22] Filed: Sep. 6, 1996

[30] Foreign Application Priority Data

Sep. 12, 1995 [JP] Japan ..... 7-234417

[51] Int. Cl.[6] ..... B41J 5/30

[52] U.S. Cl. ..... 400/61; 400/103; 400/615.2

[58] Field of Search ..... 400/61, 103, 586, 400/615.2

[56] References Cited

U.S. PATENT DOCUMENTS 5,496,117 3/1996 Sawada et al. ..... 400/103

*Primary Examiner*—John S. Hilten

*Attorney, Agent, or Firm*—Fattibene and Fattibene; Paul A. Fattibene; Arthur T. Fattibene

[57] ABSTRACT

A print control unit of a printing device is provided with a continuous/serial number print control unit which outputs character data of a plurality of blocks of a mixture of serial number print data blocks a and non-serial number print data blocks to a printer mechanism repetitively a predetermined number of times. When the continuous printing is set to print the same data on a plural number of pieces, the continuous printing is executed successively for the serial number printing data formed by the serial number processing and for the non-serial number printing data. Therefore, one time of printing processing makes it possible to obtain printed results in which are continuously printed the character blocks of a mixture of serial number character blocks and non-serial number character blocks on a plural number of pieces.

3 Claims, 5 Drawing Sheets

PRINTING DEVICE

BACKGROUND OF THE INVENTION

1. Field of the Invention

The present invention relates to a printing device and, particularly, to a print control function of a printing device for forming a lettering tape.

2. Prior Art

Printing devices have heretofore been known for printing characters onto adhesive tapes and onto tubes for electric wires by using a tape cassette that contains an adhesive tape with a peeling paper or a tube for electric wires. The printing devices of this kind have features in that character blocks such as terminal numbers, etc. can be printed maintaining any block pitch and that continuous printing and serial number printing can be accomplished. That is, terminal numbers of electric facilities are printed in serial numbers or repetitively maintaining a predetermined pitch onto a tape or a tube to form an indication label that will be stuck to a terminal plate, or a tube bearing terminal numbers is continuously formed, that will cover the end portion of an electric wire.

For instance, when a serial number indication label is to be formed in which the numerals of terminal numbers gradually increase, a serial number printing mode is selected, and start character data and a number of pieces for automatic serial number printing are input. Then, the character data are automatically updated successively from the start numeral and are printed according to the serial numbers that are set.

When the same terminal number is to be continuously printed on a plural number of pieces, a continuous printing mode is selected, and a character data are input and a number of pieces of continuous printing is specified. Then, the same character blocks are printed on a tape or a tube a specified number of times maintaining a specified pitch.

When a continuous printing and a serial number printing are set in an overlapped manner, furthermore, the head character data are continuously printed a preset number of times and, then, the character data are updated successively; e.g., serial numbers are printed continuously like X10, X10, X11, X11, - - -, X20, X20.

In the tapes or tubes for indicating wirings, it is often required to print an ordinary continuous printing block in addition to the serial number continuous printing block. In the case of tubes covering electric wires, in particular, terminal numbers are indicated at both ends of the electric wire, or character blocks are printed on a plural pieces to connect two electric wires to a terminal.

In the conventional printing devices for tapes, however, it is not allowed to continuously print a serial number printing block together with a printing block which is not the serial number printing. When it is attempted to produce a tube for covering electric wires or a tape having the above-mentioned character arrangement, it is required to print a serial number continuous printing portion separately from a continuous printing portion which is not serial number printing portion. Or, the serial number portion must be continuously printed by inputting individual character data like the ordinary printing, involving cumbersome operation.

When a series of character data comprising a continuous serial number printing portion and a continuous printing portion, are to be separately printed, furthermore, the whole character data cannot be preserved as a data file arousing a problem from the standpoint of managing the data.

It therefore becomes necessary to expand the printing function to print both the continuous serial number printing block and the continuous printing block and, hence, to solve technical problems in order to accomplish easy operation and to enhance operation efficiency. The object of the present invention is to solve the above-mentioned problems.

SUMMARY OF THE INVENTION

In order to accomplish the above-mentioned object, the present invention provides a printing device having a continuously printing function for outputting character data of a block as a unit to a printer mechanism depending upon the preset number of times of continuous printing and a serial number printing function for successively updating the numerals or alphabets of character data within a specified range in the forward direction or in the reverse direction and for outputting them to the printer mechanism, and further having a composite data processing function for successively processing data of a mixture of serial number printing data blocks and non-serial number printing data blocks based upon the block units that are set, and a continuous/serial number composite processing function for outputting the data block formed by said composite data processing function to the printer mechanism depending upon the preset number of times of continuous printing.

In the above-mentioned printer, when printing data of a plurality of blocks of a mixture of character data blocks that set the serial number printing and non-serial number printing character data blocks are input and a print start instruction is input, the printing data are read out by a print control unit with the character block as a unit. When the printing data that are read out do not contain serial number print control data, the ordinary printing is executed. When the printing data block contains serial number print control data, the print control unit changes the printing mode over to the serial number printing mode from the ordinary printing mode, successively updates the characters from the head character data to the final character data based upon the serial number print control data, and automatically print the serial numbers.

When the continuous printing is set to print a series of the same printing data on a plural number of pieces, the continuous printing is executed for the serial number printing data and for the non-serial number printing data successively, and character blocks of a mixture of serial number character blocks and non-serial number character blocks are continuously printed on a plurality of pieces through one time of printing operation.

DETAILED DESCRIPTION OF THE PREFERRED EMBODIMENTS

Figure 1:
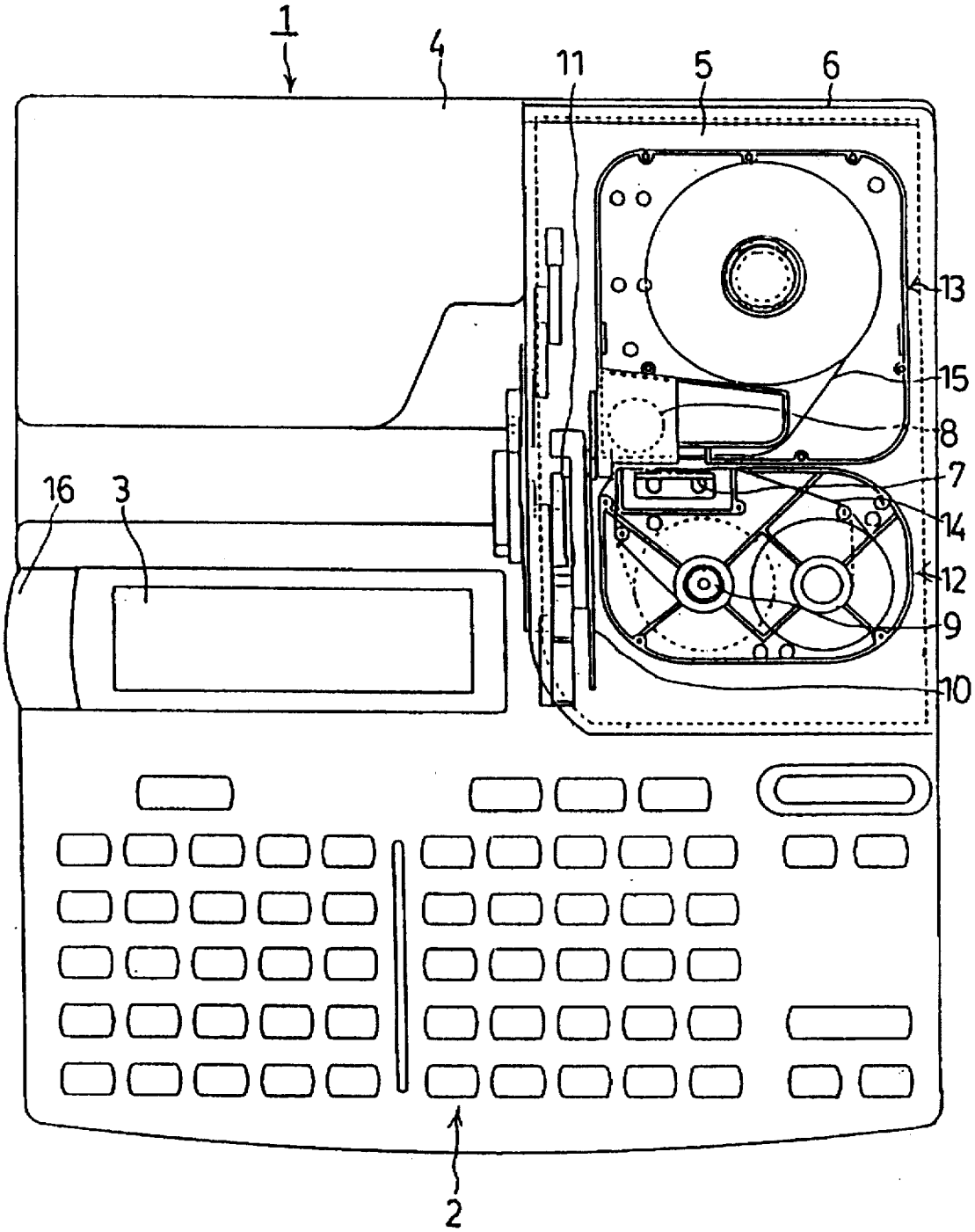
FIG. 1 is a plan view of a tape printer.

An embodiment of the invention will now be described in detail with reference to the drawings. For the sake of explanation, technology pertaining to the prior art will also be described. FIG. 1 shows a tape printer 1 having a keyboard 2 arranged on the front side and a liquid crystal display board 3 arranged on the central left side. A cassette cover 6 covers a cassette loading chamber 5 provided on the rear right side of a housing 4, and is pivoted to the housing 4 via a hinge (not shown) at the rear end and turns at its front part upwards with the hinge as a fulcrum to open the cassette loading chamber 5.

In the cassette loading chamber 5 are arranged a thermal head 7, a platen roller 8, an inked ribbon take-up reel shaft 9, a manual tape cutter 10, and a tape cutter 11 for half-cutting. When an inked ribbon cassette 12 and a tube cassette 13 or an adhesive tape cassette are loaded at predetermined positions and are opposed to each other, the inked ribbon 14 of the inked ribbon cassette 12 and the tube 15 of the tube cassette 13 or the adhesive tape are located between the thermal head 7 and the platen roller 8.

When characters or symbols are input by using the keyboard 2, the content that is input is displayed on the liquid crystal display board 3. When a print execution command is input, the printer mechanism is driven to rotate the platen roller 8, whereby the inked ribber 14 and the tube 15 or the adhesive tape run interlocked thereto being pressed by the thermal head 7 and the platen roller 8, and the heat-sensitive ink of the inked ribbon 14 is heat-transferred onto the tube 15 by the thermal head 7, and the tube 15 is delivered sidewards. Upon depressing a manual cut button 16 provided at the left edge of the housing 4, the tube 15 or the tape that is delivered is cut by a manual tape cutter 10 that is coupled to the manual cut button 16 through a link.

Figure 2:
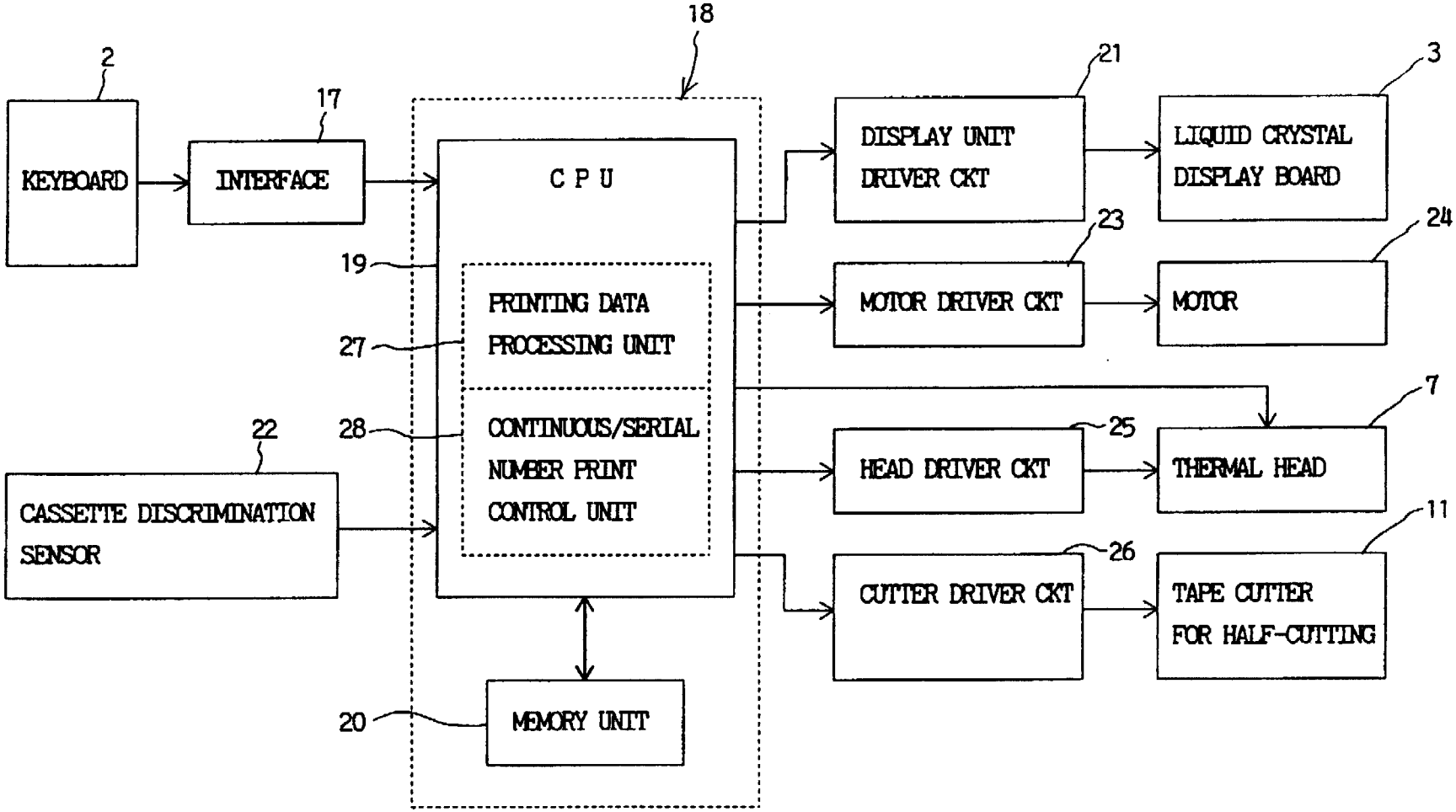
FIG. 2 is a block diagram of the tape printer of the present invention.

FIG. 2 is a block diagram of the tape printer 1, wherein an output signal of the keyboard 2 is input to a CPU 19 in a print control unit via an interface 17 and is written onto a memory unit 20, and the CPU 19 drives a display unit driver circuit 21 so that the content that is input is displayed on the liquid crystal display board 3.

The tube cassette 13 or the tape cassette indicates identification data such as kind and width of the tape or the tube contained therein by way of an identification data indication means such as an identification hole or an identification code indication label provided on the cassette body. A known printing medium identification mechanism is constituted by a cassette identification sensor 22 such as limit switch or photo sensor provided in the cassette loading chamber of the tape printer 1.

At the time of executing the printing, the CPU 19 controls a motor driver circuit 23, and drives a motor 24 that actuates the platen roller 7 and the inked ribbon take-up reel 9, in order to transfer the printing data to the thermal head 7 while delivering the tape or the tube for the electric wire. The CPU 19 further outputs control signals to a head driver circuit 25 to drive the thermal head 7 and the motor 24 in synchronism, so that the heat sensitive ink of the inked ribbon 14 is heat-transferred onto the adhesive tape and onto the tube 15 for the electric wire.

The tape printer 1 is provided with an automatic half-cutting function for cutting the adhesive tape only of the adhesive tape having a peeling paper along a boundary line of the printing blocks and for half-cutting the tube for the electric wire, and a boundary line printing function for printing a vertical line on the boundary of the printing blocks. These functions can be turned on or off by manipulating the keyboard 2. When the automatic half-cutting function is selected, the CPU 19 controls a cutter driver circuit 26 that drives a tape cutter 11 for half-cutting, and the tape or the tube for the electric wire is half-cut among the printing blocks. Upon effecting the half-cutting, the printing blocks printed on the tape can be separated into pieces and stuck or the tube for the electric wire can be mounted on the end of the electric wire with ease.

To set the format such as character size, block pitch, etc. and to set continuous printing or serial number printing, a desired setting mode is selected by using the keyboard 2. Then, a character size is set, block pitch is set and serial number printing is set according to a setting menu displayed on the liquid crystal display board 3, and the character data are input. The setting data such as continuous printing or format, serial number/continuous printing data and the character data are stored in a memory unit 20. At the time of executing the printing, a printing data processing unit 27 in the CPU 19 converts the character data into dot data according to the printing setting. The continuous printing and the serial number printing are controlled by a continuous/serial number print control unit 28.

Figure 3:
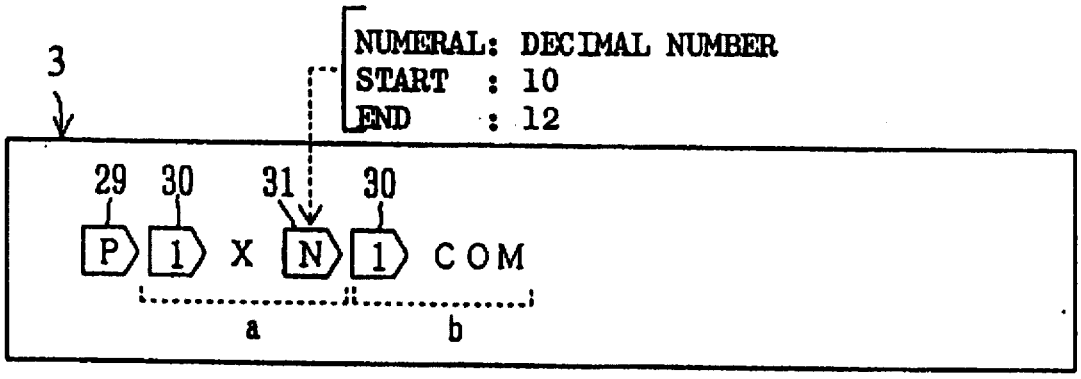
FIG. 3 is a diagram illustrating the screen display of character data of a mixture of serial number printing character data and non-serial number printing character data.

When the data are input, the function key and the pitch setting key are manipulated to select a pitch setting mode thereby to set a block pitch. A pitch value is input according to a setting menu displayed on the liquid crystal display board 3, whereby block pitch data are input to the print control unit 18 and a block pitch control sign 29 is displayed on the liquid crystal display board 3 as shown in FIG. 3. Then, a print line designation operation is carried out to display a print line control sign 30, and character data are input.

To set the serial number printing, a continuous/serial number key on the keyboard 2 is manipulated to display a serial number print control sign 31 on the liquid crystal display board 3. Then, according to the setting menu on the liquid crystal display board 3, a start character of numeral or alphabet and the number of pieces for printing serial numbers are input or the start character and end character are input to write the serial number print setting data a onto the memory unit 20. Octal notation, decimal notation or hexadecimal notation can be selected for the serial numbers.

To print, for example, serial numbers X10, X11, X12, fixed character data X are input as shown and, then, the serial number print control sign 31 is displayed to set serial numbers=decimal, start numeral 10, end numeral 12. After the serial number print setting data a, there can be continuously input a character data block b of ordinary printing and other serial number print setting data.

To effect the continuous printing, the continuous/serial number key is manipulated on the keyboard 1 to display a continuous printing setting screen (not shown) on the liquid crystal display board 3, and a number of pieces of continuous printing is input according to the setting menu on the liquid crystal display board 3 followed by the defining operation.

Figure 4:
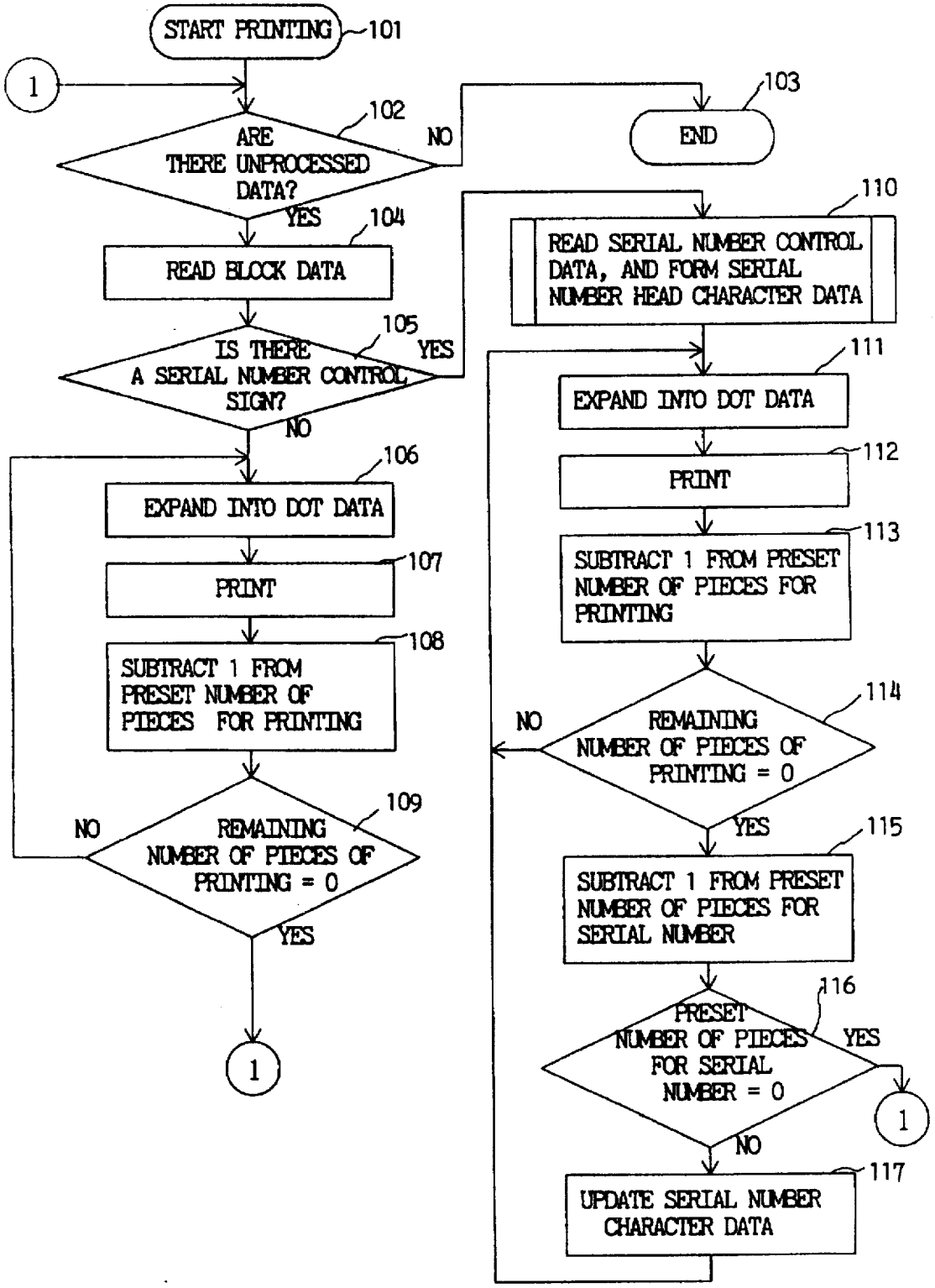
FIG. 4 is a flow chart for controlling the printing by the tape printer of the present invention.

FIG. 4 illustrates the flow of control by the print control unit 18. First, when a print start instruction is input, the printing processing starts (step 101). When there are printing data, a head printing data block in the memory 20 are read by the CPU 19 (step 104).

When the serial number print control sign 31 is not contained in the print data block, the program proceeds from a step 105 to a step 106, the printing data processing unit 27 expands the character data into dot data which are successively transferred to the thermal head 7 and, at the same time, the motor driver circuit 23 and the head driver circuit 25 are driven to execute the printing (step 107).

Then, the continuous/serial number print control unit 28 subtracts 1 from a preset number of pieces for printing (step 108). When the continuous printing has not been set, the result of operation becomes zero, and the program returns from a step 109 to the step 102 where the next printing data block is read out.

When there have been set two or more pieces of continuous printing, the program returns from the step 109 back to the step 106, and the printing of the same character data is repeated. When the preset number of pieces of printing is finished, the program returns back to the step 102.

When the serial number print control sign 31 is included in the character data block that are read out at the step 102, the program proceeds from the step 105 to a step 110 where the serial number print setting data are read out, the continuous/serial number print control unit 28 changes the printing mode over to the serial number printing mode to form a head character data of serial number, expands the character data into dot data (step 111) and executes the printing (step 112).

Then, 1 is subtracted from the preset number of pieces for printing (step 113). When the continuous printing has not been set, the program proceeds from a step 114 to a step 115 where 1 is subtracted from the number-of-pieces data in the serial number print setting data. When the number of pieces for serial number printing is net reaching a setpoint value (step 116), the printing data are updated to a character data which is the second data in the serial number (step 117). When the preset number of pieces for printing serial number is reached through the dot data expansion processing (step 111) and the printing (step 112), the serial number printing processing is finished, and the program returns from the step 116 to the step 102 where the next character data block is read out.

When two or more pieces of continuous printing is set, furthermore, the printing, after the printing of the first piece, returns from the step 114 back to the step 111 where the printing of the same character data is repeated. After the printing of the preset number of pieces is finished, the program proceeds from the step 114 to the step 115 where the program shifts to the above-mentioned serial number control routine. When the continuous printing is set as described above, the continuous printing is executed even for the character data that are formed by the serial number print setting data.

Figure 5A:
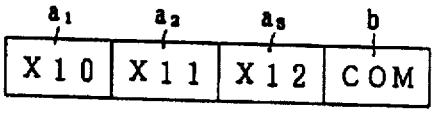
FIG. 5 is a diagram illustrating the printed results based upon the input data of FIG. 3, wherein FIG. 5(*a*) is a diagram illustrating the printed results of a piece of printing, and FIG. 5(*b*) is a diagram illustrating the printed results of when two pieces of continuous printing are set.
Figure 5B:
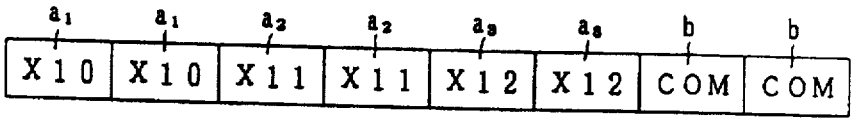

Therefore, when the printing data of a mixture of serial number print setting data a and non-serial number printing data b, are printed by setting the number of pieces for printing to be one, then, the serial number block a of serial numbers and the non-serial number block b are each printed one time as shown in FIG. 5(*a*). When the above data are printed by setting the number of pieces for continuous printing to be two, the serial number block a and the non-serial number block b are each printed two times as shown in FIG. 5(*b*).

According to the present invention as described above, a control function is provided to continuously print a series of printing data consisting of a mixture of serial number printing data and non-serial number printing data. It is therefore made possible to continuously print a mixture of the non-serial number character blocks and serial number character blocks that could not be printed so far, requiring reduced amount of burden since there is no need to print non-serial number portions separately from the serial number portions, or to individually input character data of serial number portions for effecting the continuous printing. Accordingly, the printed matter can be formed very efficiently.

Here, it should be noted that the present invention is in no way limited to the above-mentioned embodiment only but permits the hardware circuit blocks and the procedure of print control to be modified in a variety of ways without departing from the spirit and scope of the invention, as a matter of course.

What is claimed is:

1. A printing device comprising:

a continuously printing means for outputing character data of a block as a unit to a printer mechanism depending upon a preset number of times of continuous printing and a serial number printing means for successively updating numerals or alphabets of character data within a specified range in a forward direction or in a reverse direction and for outputting them to the printer mechanism, and further having a composite data processing means for successively processing data of a mixture of serial number printing data blocks and non-serial number printing data blocks based upon the block units that are set, and a continuous/serial number composite processing means for outputting the data block formed by said composite data processing function to the printer mechanism depending upon the preset number of times of continuous printing.

2. A printing device for repetitively printing information on a label a preset number of times having a serial number block and a non-serial number block comprising:

a printer;

a keyboard attached to said printer;

continuous/serial number print control means, coupled to said printer, for controlling printing data;

composite data processing means for successively processing data representative of the serial number block and the non-serial number block;

means for setting a number of pieces of the serial number block for continuous printing with the same serial number;

means for setting a number of pieces of the non-serial number block for continuous printing;

serial number updating means, coupled to said continuous/serial number print control means, for successively updating a serial number within a specified range;

printer data processing unit means for processing character data; and memory unit means, coupled to said continuous/serial number print control means and said printer data processing unit means, for storing setting data such as continuous printing or format, serial number/continuous printing data and character data, whereby the label is printed having a preset number of repeating serial number blocks and non-serial number blocks with the serial number blocks also successively being printed with updated serial numbers.

3. A method of printing a label having a serial number block and an non-serial number block with a printing device comprising the steps of:

inputting block data to be printed on the label into memory;

inputting print line control data indicating a number of pieces to be printed;

inputting serial number print setting data, the serial number print setting data including a decimal, a start numeral, and an end numeral;

continuously printing the serial number block for the number of pieces to be printed;

changing the start numeral by the decimal and updating the serial number print setting data;

repeating said steps of continuously printing the serial number block data and advancing the start numeral until the end numeral is reached; and printing the non-serial number block data for the number of pieces to be printed, whereby a composite label is formed having serial number blocks and a non-serial number blocks that are printed a predetermined number of times preventing the need for repetitive data entry.

* * * * *